US005159743A

United States Patent [19]

Somerville

[11] Patent Number: 5,159,743

[45] Date of Patent: Nov. 3, 1992

[54] HYDRAULIC PULLER

[75] Inventor: Dean S. Somerville, McHenry, N. Dak.

[73] Assignee: Posi Lock Puller, Inc., Cooperstown, N. Dak.

[21] Appl. No.: 349,078

[22] Filed: May 8, 1989

[51] Int. Cl.[5] ..... B25B 27/02

[52] U.S. Cl. ..... 29/252; 29/261; 29/265

[58] Field of Search ..... 29/252, 261, 258, 263, 29/264, 265

[56] References Cited

U.S. PATENT DOCUMENTS

| | | | |
|---|---|---|---|
| 1,581,057 | 4/1926 | Hill . | |
| 2,003,756 | 6/1935 | Nagel | 29/261 |
| 2,303,560 | 12/1942 | Knight | 29/261 |
| 3,108,792 | 10/1963 | Martin | 269/70 |
| 3,337,943 | 8/1967 | Powell | 29/261 |
| 3,791,011 | 2/1974 | Keys | 29/252 |
| 3,908,258 | 9/1975 | Barty | 29/252 |
| 4,007,535 | 2/1977 | Brandt | 29/261 |
| 4,068,365 | 1/1978 | Brandt | 29/261 |
| 4,257,163 | 3/1981 | Bauer | 29/252 |
| 4,459,728 | 7/1984 | Gaquère | 29/252 |
| 4,648,166 | 3/1987 | Tilman | 29/252 |

OTHER PUBLICATIONS

Pages 7, and 73 through 82 of "Enerpac" catalog circa 1988 or 1989.

Unmarked two pages and pp. 80, 81, and 84 through 87, and 92 through 101, of OTC Power Team catalog, circa 1988 or 1989.

*Primary Examiner*—J. J. Swann

*Attorney, Agent, or Firm*—Zarley, McKee, Thomte Voorhees & Sease

[57] ABSTRACT

The hydraulically powered locking puller device comprises a base assembly about a central axis, a camming assembly circumferentially about the base assembly, and an hydraulic module axially centered within the base assembly. The base assembly has a cylindrical housing wall united to an anchor ring carrying at least two claw members and having an internally threaded cylindrical surface. The camming assembly includes a mooring ring mounted on the housing wall of the base assembly for axial movement therealong and a cam ring axially spaced from a coupler on the mooring ring. The cam ring is in camming relationship to the claw members. The hydraulic module includes a plunger with a replaceable tip, a spring retractor, a carrying ring for hoist movement of the puller, and threads for cooperative threading with the internal threads of the anchor ring to fix the hydraulic module against axial shift, but yet permit easy removal of it for servicing and replacement without disturbing any part of the relationship and elements of the base assembly and camming assembly. A shoulder within the anchor ring provides an abuttment against which the hydraulic module is lodged in assembly.

3 Claims, 2 Drawing Sheets

HYDRAULIC PULLER

BACKGROUND OF THE INVENTION

This invention relates to an hydraulic puller system, and more particularly to an hydraulically powered locking puller device having a base assembly about a central axis, a camming assembly circumferentially about the base assembly, and a readily removable hydraulic module axially-centered in the base assembly. The invention also relates to a method for convenient assembly, and also disassembly, of parts of the puller device, especially as modular units.

This teaching provides the benefits of a locking puller in combination with the benefits of an hydraulically powered system without sacrificing economy of structure and with the advantage of ease of removal and reattachment of the part most subject to wear failure, namely the hydraulic system.

Locking puller devices have heretofore been known, as illustrated in Knight U.S. Pat. No. 2,303,560, and also in the United States patents of Brandt and Somerville, namely U.S. Pat. No. 4,007,535, issued Feb. 15, 1977, and U.S. Pat. No. 4,068,365 issued Jan. 17, 1978. Brandt and Sommerville U.S. Pat. No. 4,007,535 suggests manufacturing an hydraulic cylinder in the center bore in place of a threaded rod. Manufacturing hydraulic components within a center bore is difficult and expensive. An hydraulic puller device, and one specifically having an externally threaded hydraulic cylinder for a jaw assembly, is illustrated in Hill U.S. Pat. No. 1,581,057, issued Apr. 13, 1926. Still other hydraulic pullers have been placed on the market, but lack convenient locking or camming of puller elements and generally require awkward claw or jaw assemblies and awkward arrangements for the components.

Insofar as is known, all prior art hydraulic puller teachings have totally failed to address and have not suggested the formation of an hydraulically powered locking puller permitting easy discrete separation of the entire hydraulic system from remaining parts of the locking puller without need to dismantle the hydraulic system and without need to dismantle or loosen or adjust any other part or assembly of parts of the locking puller.

The need for reliable easy-to-use hydraulic pullers is primarily for pulling large gears or bearings or other elements frozen or friction fitted on relatively large shafts or structures of large equipment. Tackling such a job generally requires a relatively large puller and one not easily shifted in position by human muscle strength. Hoist equipment for movement of the puller into position is frequently needed.

Insofar as known, no one has devised an hydraulically powered locking puller satisfactory for such jobs and equipped with elements to which a chain or other connector for hoist movement of the puller is conveniently affixed.

SUMMARY OF THE INVENTION

The hydraulically powered locking puller device of this invention is comprised of three discrete and separately identifiable assemblies. The hydraulic assembly or module is easily removed from its anchored position in a base assembly without otherwise disturbing any part or portion of the base assembly or any other part of the puller.

The base assembly of the puller comprises a cylindrical housing wall having a threaded exterior and relatively large internal diameter. This wall is unified at its head end to an anchor ring and is open at its butt end. The preferred anchor ring has a relatively large diameter cylindrical internal surface adjacent its unification to the housing wall; and this larger diameter portion carries threads and terminates at an internal shoulder. The head end of the hydraulic module is received in this part of the anchor ring. The remaining part of the anchor ring has a relatively smaller internal diameter. The portion having the smaller internal diameter carries at least two claw members, sometimes called jaw members. These claw members are pivotally attached to the anchor ring at their heel ends so as to allow free radial movement for their toe ends.

The second assembly of the puller device is called the camming assembly. It comprises a rotatable internally-threaded mooring ring mounted in threaded relationship on the threaded exterior of the cylindrical housing wall of the base assembly, and additionally comprises a non-rotatable cam ring fixed in axially spaced relationship to a ring coupler carried on the mooring ring. The cam ring is oriented for camming action on the claw members of the base assembly. Rotational movement of the mooring ring on the threaded exterior of the cylindrical housing wall has the effect of causing or effecting axial movement of the cam ring, which in turn cams radial movement of the claw members.

The third assembly of the puller is the hydraulic module. It comprises a hydraulic cylinder having an external diameter slightly smaller than the internal diameter of the cylindrical housing wall. An interior cylindrical hydraulic chamber is within the cylinder. A plunger having a piston end is within the hydraulic chamber and its distal end projects outwardly from the chamber. A coupling means is provided at a port into the chamber for passing hydraulic fluid into the chamber for action upon the piston end of the plunger to force the plunger in an outward direction from the head end of the hydraulic cylinder. Also provided is means for retracting the plunger toward the butt end of the hydraulic cylinder. Fastening means on the cylinder permits attachment of the head end of the hydraulic cylinder to the anchor ring of the base assembly in a manner preventing axial shift of the hydraulic cylinder with respect to the anchor ring.

The exterior diameter of the hydraulic cylinder is sufficiently less than the interior diameter of the housing wall so as to avoid significant friction resistance as the two portions are shifted axially with respect to one another to accomplish assembly or disassembly.

In the most preferred embodiment, the anchoring attachment of the hydraulic module to the anchor ring of the base assembly is by means of cooperatively threaded parts on the exterior of the hydraulic cylinder and the interior of the anchor ring at its larger internal diameter portion.

An especially desired added feature of the hydraulic module is that of a carrying ring element fixed to the butt end of the hydraulic cylinder. The carrying ring element has a diameter in excess of the diameter of the hydraulic cylinder, by at least about 20%. It is useful to fasten or anchor a chain or other connector from a hoist for the purpose of moving the hydraulic puller. Additionally, the relatively large diameter for the carrying ring element serves the function of protecting the parts of the puller near it from accidental contact damage since it is the element most likely to suffer contact damage in the even the puller is dropped or tipped over in use.

Still other benefits and advantages of the invention will be evident as this description proceeds.

BRIEF DESCRIPTION OF PREFERRED EMBODIMENT

Figure 1:
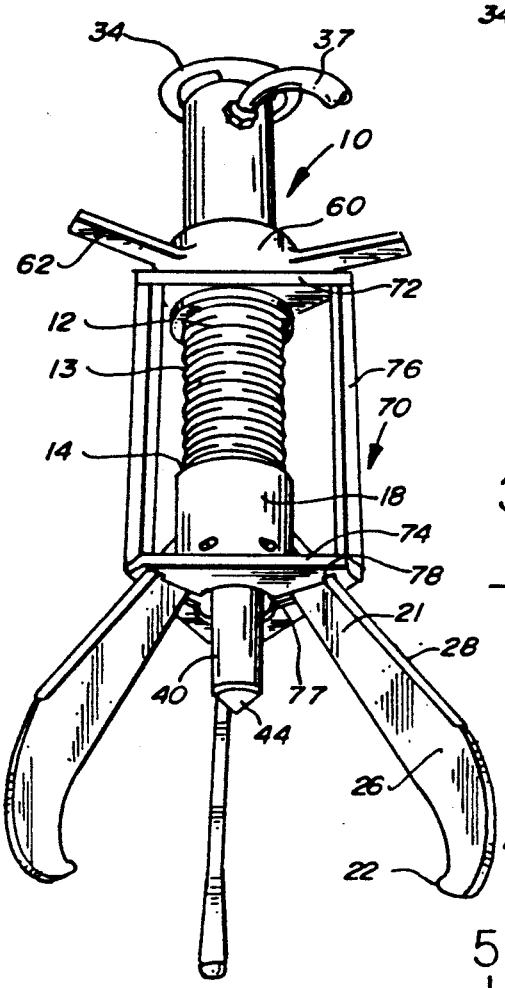
FIG. 1 is a schematic perspective view of the hydraulic locking puller device of the invention, and illustrates it with the mooring ring of the camming assembly at a location near the top or butt end of the cylindrical housing wall of the base assembly.
Figure 2:
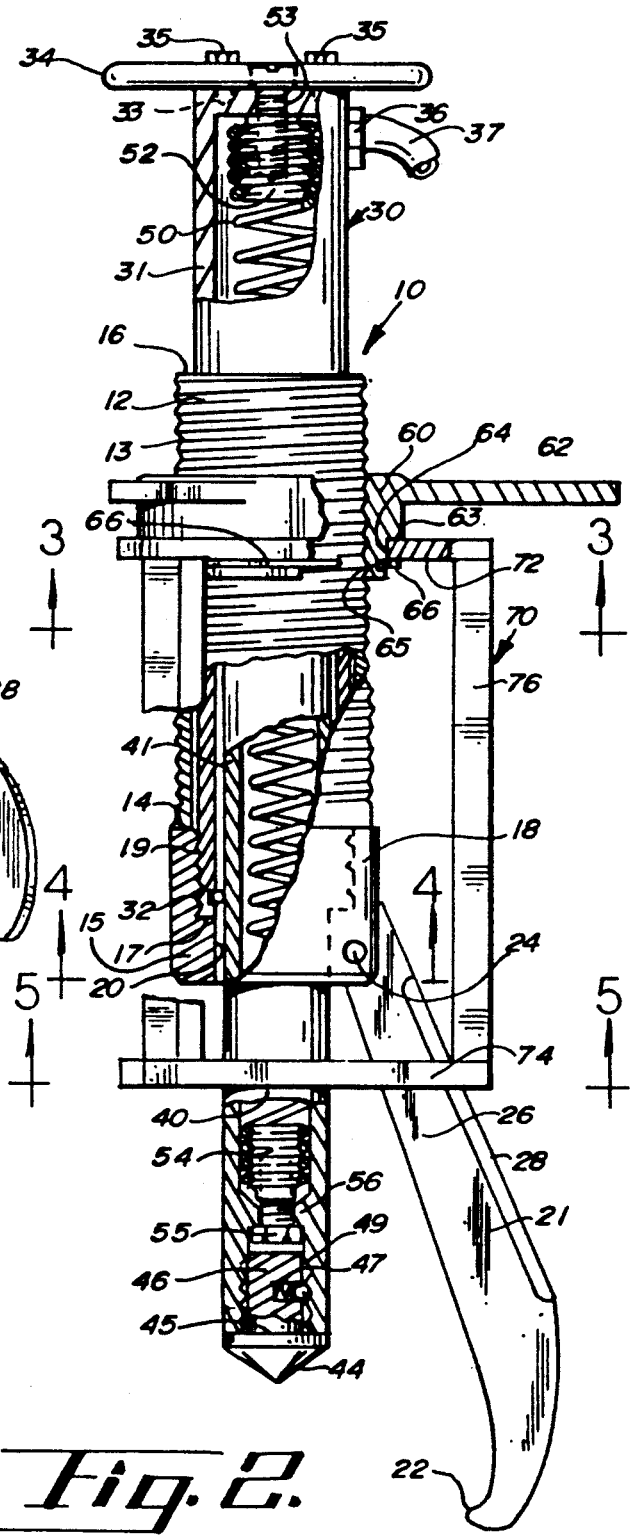
FIG. 2 is a schematic side view of the device, with several parts partially broken away, and some in section, so as to illustrate internal relationships and details.
Figure 3:
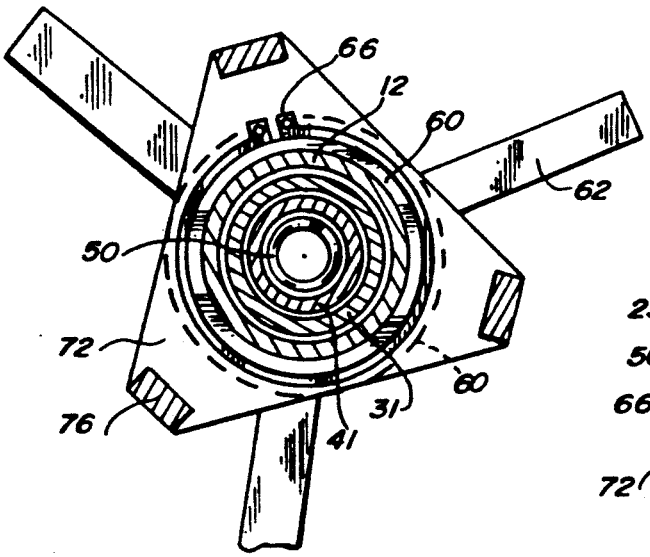
FIG. 3 is a schematic cross-sectional view taken on line 3—3 of FIG. 2.

Referring particularly to FIGS. 1 and 2, the plunger comprises a base assembly or module 10, an hydraulic module 30 and a camming assembly 70.

The base assembly itself is formed of a cylindrical housing wall or sleeve 12 having an unusually large internal diameter designed to accommodate the diameter of an hydraulic cylinder in spaced relationship. It has external spiralled threads 13, a head end 14, a butt end 16, and preferably a relatively smooth internal diameter surface. The head end 14 is unified as by welding or casting or otherwise to an anchor ring 18. While anchor ring 18 is illustrated as having a generally cylindrical exterior, it may be formed so as to have other than a cylindrical exterior. Its exterior radially-outward extent, however, is not substantially greater (or only fractionally greater) than the outer diameter of the wall 12. Its interior is preferably defined by generally cylindrical shapes, as will be explained. The anchor ring itself should have a substantial body or thickness from its inner interior cylindrical forms to its exterior wall or surface. Most ideally, the housing wall or sleeve 12 has a slightly greater internal diameter than that of the anchor ring 18 at its portion adjacent the unification between the anchor ring 18 and the housing wall. This permits easy movement of the hydraulic cylinder into sleeve 18. The portion of the anchor ring unified to the sleeve is equipped with internal threads 19 on a cylindrical interior surface. The threads serve for threaded anchoring of the hydraulic module to the anchor ring 18. This threaded portion of the anchor ring terminates at an internal shoulder 17 against which the head end of the hydraulic cylinder wall 31 abutts, which contributes to solid anchoring of it. The remaining or distal portion 15 of the anchor ring has a relatively smaller internal diameter 20 as compared to the threaded portion 19. The distal end 15 (as particularly illustrated in FIG. 4) has a body bulk of continuous non-threaded and preferably smooth form about the internal annulus of the smaller diameter. Further, the body bulk of the entire distal part (or head end part) 15 of the anchor is solid except for the slots 23 into it for firm pivot anchoring of claws or jaws for the puller.

Figure 4:
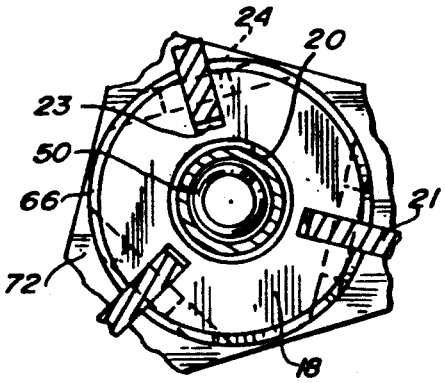
FIG. 4 is a schematic cross-sectional view taken on 4—4 of FIG. 2.
Figure 6:
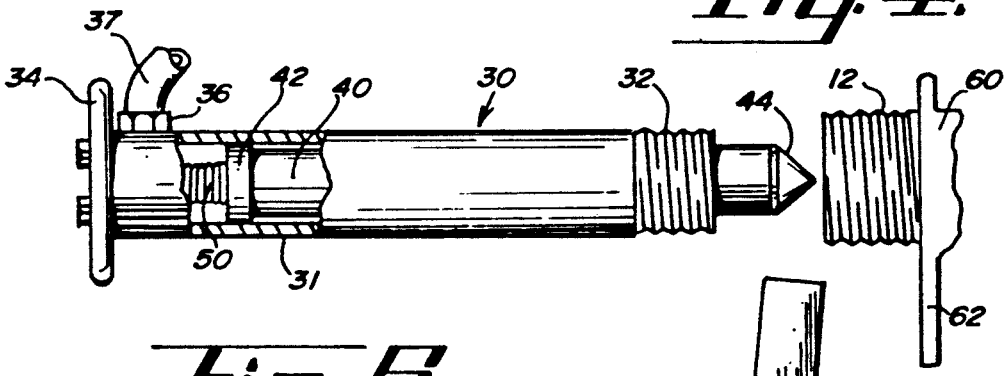
FIG. 6 is a schematic exploded or disassembled view illustrating the hydraulic module in removed condition with respect to the base assembly.

In FIG. 1, three claw members are illustrated, one of which is given the number 21. The same claw member 21 is illustrated in FIG. 2. These claw members—whether 2, 3, 4 or more are employed—are suitably characterized as having a toe end 22 (sometimes called the nose end), and a heel end at the opposite end thereof. The heel end is illustrated in FIGS. 2 and 4 as being recessed in a radially slot 23 of anchor 18 and fastened by a pivot pin 24 in the radial slot. The pivot anchoring of the heel end by pins 24 permits radial pivoting or shifting movement of the toe end of the claw members. Each claw member is suitably characterized as having a web-like flange 26 extending between the heel and toe end and as having at its radially outward exterior a spine 28. The spine 28 is generally characterized by a bulge of material on each side of the basic web-flange 26 so as to, in effect, give a T shape appearance for a cross section transversely through the claws.

The illustrated base assembly therefore consists of the cylindrical housing wall or sleeve 12, the anchor ring 18, and the pivotally attached claws 21.

The hydraulic module 30 will be described by reference to elements numbered 31 through 56 in the drawing.

The hydraulic module has an exterior cylindrical wall 31 of generally uniform diameter throughout its length, and has a smooth surface except for the head end which is provided with threads 32 which cooperatively mate in threading action with threads 19 of the anchor 18.

The butt end of the hydraulic module is provided with any suitable butt plate 33 as a closure for the cylinder. A circular carrying ring lifter 34 has internal radial bracing (or a few spokes) to a circular internal disc which is attached as by bolts 35 to butt end plate 33. The ring lifter 34 has openings interiorly of the ring so as to permit a chain or other fastener to pass through and be appropriately secured for hoist lifting of the puller. A chain for hoist lifting may also be passed around brace elements 76 of the cam cage assembly. The ring lifter 34 and the cage elements (e.g., coupler ring 72, cam ring 74, and braces 76) also perform a protective function in shielding the hydraulic module and the threads 13 on the sleeve 12 from damage in the event the puller is dropped or tipped over in use.

A port into the interior of the hydraulic cylinder is provided with a coupling means or member 36 for the attachment of an hydraulic conduit or hose 37. The port equipped with coupling 36 effectively operates as an entrance as well as exit port for hydraulic fluid communicated through hose 37. A suitable pumping or pressure system and reservoirs for hydraulic fluid are all omitted from the drawings since they are of conventional well known nature.

A plunger 40 extends axially within the cylindrical cavity or chamber of the hydraulic cylinder an is itself cylindrical in nature. The external diameter of the plunger is smaller than the internal diameter 20 of the distal end 15 of the anchor ring 18, and passes freely through the interior of that distal end. The plunger 40 is suitably provided with an interior cylindrical recess, for reasons which will be explained, and therefore the plunger has a cylindrical wall 41 which defines its external surface as well as its interal surface. The butt end of the plunger is equipped with a piston 42 suitably in slidably sealed relationship at its external circumference with the interior of the hydraulic cylinder wall 31. In the preferred embodiment, the piston 42 is provided with an interior cylindrical or annular surface permitting fluid communication with the interior recess of the plunger 40. A fluid sealing ring or wiper ring (not numbered in the drawing) is located between the plunger wall 41 and the interior of the threaded head end of the hydraulic cylinder wall 31.

The head end of the plunger is suitably equipped with a tip 44 carried on a saddle structure having a shoulder 45. This saddle shoulder 45, while illustrated in FIG. 2, is more clearly illustrated in FIG. 7 for an alternate tip arrangement for the plunger. Extending axially inward from shoulder 45 (i.e., extending from shoulder 45 toward the butt end of the assembly) is a stub shaft 46 having a radial recess into it in which a spring 47 functions to press against a ball detent 48 (see FIGS. 2 and 7). The head end of the plunger wall 41 terminates at a circular rim edge and the head end has an internal annular recess with circular grooves such as formed by threads or internal annular ridges 49. As the saddle structure for the tip end is inserted in the head end plunger wall recess of the main body of the plunger, the spring 47 forces ball 48 into or against the non-smooth or roughened surface 49 of the end to frictionally hold the saddle structure for the tip in place at the head end of the plunger, with the saddle shoulder in abuttment against the rim edge of the plunger wall.

A spirally coiled retracting or recoil spring 50 is located within the plunger and extends through the piston end into the hydraulic chamber. The end of the spirally coiled spring 50 toward the butt end of the hydraulic cylinder is lodged in a spirally grooved mounting block 52 in a manner such that the spiral coils for that end of the spring are fixed in position and cannot be stretched apart. The mounting block 52 is secured to the butt end plate 33 of the hydraulic assembly as by a bolt member 53 extending into the mounting block 52 and holding it against the butt plate 33. A similar spirally grooved mounting block 54 is secured by bolt 55 at end wall 56 within the plunger. Thus the spiral spring 50 is held at its ends by the spiral grooves of the mounting blocks but is free for extension and contraction at all portions between those ends. It will be evident that hydraulic fluid entering hose 37 under suitable pressures in hydraulic operation effectively presses against piston 42 as well as against the end wall 56 in forcing outward projection of the complete plunger system of the hydraulic module. Further, when the hydraulic pressure for incoming fluid is terminated, as by turning a valve (not shown) to allow exit of hydraulic fluid from the cylinder into a reservoir, the spring 50 contracts and draws plunger 40 toward the butt end of the hydraulic cylinder, thereby causing exit of hydraulic fluid from the hydraulic cylinder.

Next to be discussed is the camming assembly which is orientated circumferentially about the base assembly.

A foundational part of the camming assembly is the mooring ring 60. It is equipped with internal threading in cooperative relationship with the external threads 13 on the cylindrical wall or sleeve 12. Thus, rotation of the mooring ring 60 about the sleeve 12 moves the mooring ring in an axial direction either toward the head end or the butt end of the base sleeve 12. Arm handles 62 are unified to the mooring ring 60 and project radially outward. This permits convenient hand rotation of the mooring ring on the threads about the sleeve 12.

To be emphasized is that the radially projecting handle members 62 are toward the butt end of the assembly, whereas the features of the mooring ring for carrying a cage and other elements are relatively toward the head end and therefore underneath the handle members 62 as shown in the drawing. Features of the mooring ring toward the head end of the assembly are an annular shoulder 63 a relatively smaller external diameter section or annular surface 64 below the shoulder, a groove 65 in the smaller diameter section, and snap ring 66 in the groove.

The mooring ring 60 carries a cage assembly having a top plate or ring coupler 72 with an interior annular edge defining a circular opening, a bottom caming plate or ring 74, and brace elements 76 extending between the top ring coupler 72 and cam ring 74, and spacing those elements apart in the axial direction.

The ring coupler 72 of the cage is fitted on the smaller diameter annular surface 64 against the shoulder 63 of the mooring ring, and then the snap ring 66 is placed in position to hold the coupler 72 against axial shift with respect to the mooring ring 60.

Threaded rotation of the mooring ring of course effects movement of it in the axial direction, and that in turn effects movement of the cage in an axial direction. The relationship of the annular internal edge of the top ring coupler 72 with respect to the mooring ring is that allowing free rotation of the mooring ring without rotation of the cage. Camming ring 74 is spaced axially from the mooring ring and oriented in a relationship for camming contact with the claws 21.

Figure 5:
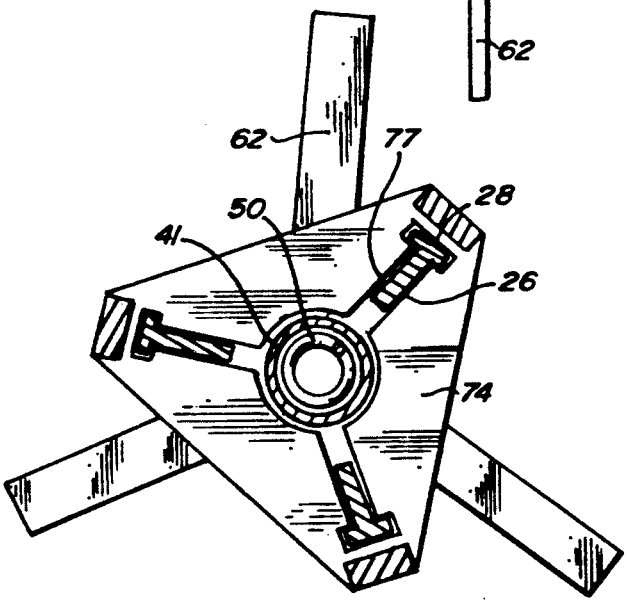
FIG. 5 is a schematic cross-sectional view taken on 5—5 of FIG. 2.

As particularly illustrated in the drawings of the preferred embodiment (FIGS. 1, 2, and 5), the spine 28 of each claw 21 is a thickened portion having lateral projections. A cross section through the claw at any point along its length appears to have a T shape (the flange 26 of the claw being the upright stem or leg of the T and the laterally projecting bulges of the spine 28 being the arms of the cross member of the T). The camming plate or ring 74 is equipped with slot recesses 77 complimentary in shape to the selected cross sectional shape of the claws. Thus the radial slot recesses 77 of the cam ring 74 are equipped with lateral recesses accommodating the lateral T cross bar projections of the spine 28 of each claw. The spine of the claw rubs against the T shaped opening in which it is located when the cam ring 74 is moved in an axial direction, either up or down. Thus the claws are forced in a radial direction by axial shift of the cam assembly.

In the illustrated preferred embodiment, the toe members 22 of the claws 21 are curved inwardly toward the axis of the structure. They are designed to grip a bearing or the like to be pulled from its frozen condition on a shaft—the bearing and shaft not being shown but well understood. As the mooring ring is rotated toward the head end of the puller illustrated in FIGS. 1 and 2, the cage carrying the caming ring 74 is also moved in that same axial direction, with the result that the caming ring forces the claws 21 radially inward. The extent of radially inward movement by the claws 21 is determined by the extent of axial movement of the caming ring effected by rotation of the mooring ring 60. After toe members 22 make an engaging contact with a bearing or the like, only slight further rotation of the mooring ring 60 is effective to fixedly cam claws 21 into a tight or locked condition against an undersurface of the bearing to be pulled from its frozen condition on a shaft.

Thereafter, hydraulic fluid is pumped or otherwise let under pressure into the hydraulic cylinder chamber to effect outward movement of the plunger 40 to cause the tip end 44 of the plunger to abut against the end of the shaft from which a frozen bearing is to be removed. Continued hydraulic fluid introduction under pressure conditions is effective to cause the toe end 22 of the claw members to pull the frozen bearing (or any analogous structure) from the shaft. Stated more perfectly, the introduction of hydraulic fluid into the chamber of the hydraulic module has the effect of causing immense pressure to be applied by the plunger 40 upon the end of a shaft on which a frozen bearing is located; and the actual movement of the entire puller device with the exception of the plunger and piston is that of a reactive movement, namely that of a movement in the butt end direction with the result that the frozen bearing is pulled by the toe ends of the claws from the shaft.

It is especially emphasized that the hydraulic module is quickly removed from its lodged condition within the sleeve 12 of the base assembly. It is easily slidable into the large diameter sleeve of the base assembly. Threads 32 of the hydraulic module mate with threads 19 in the anchor ring 18. Rotation of the handle carry member 34 of the hydraulic module effectively either threads the module into the anchor 18 against shoulder 17 of anchor 18 for secure attachment against axial shift with respect to anchor 18, or unthreads it from the anchor 18 so that the module may be easily removed and serviced or repaired and replaced.

Figure 7:
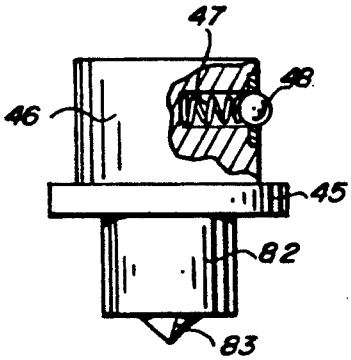
FIG. 7 is a schematic side view of an alternative saddle tip for the hydraulic plunger of the puller.

A variety of tip ends for the plunger may be employed. The diameter and contour of the tip are generally dictated by the nature of the shaft and bearing or other structure to be separated. The invention embraces the concept of extremely convenient change of tip saddle ends as by simply popping one tip out and popping another into the circularly grooved annular end recess of the main body of the plunger. An alternative tip is illustrated in FIG. 7. It has a stub projection 82 with centered point 83 extending from the outer side of the shoulder 45.

It will be appreciated that various modifications may be made from the illustrated preferred embodiment without departing from the spirit and essential features of the invention. The illustrated embodiment is therefore to be considered in all respects as illustrative and not restrictive, the scope of the invention being indicated by the appended claims rather than by the foregoing description; and all changes within the range of equivalency for the claims are intended to be embraced thereby.

That which is claimed is:

1. A hydraulically powered backing puller device for pulling a gear from a shaft, comprising:

a base assembly including an elongated cylindrical housing having an externally threaded portion, an open butt end and an open head, said base assembly including an anchor ring operatively secured to said cylindrical housing at the head end thereof, at least two claw members pivotally mounted on said anchor ring in a radial fashion with respect to the longitudinal axis of said cylindrical housing for engagement with the gear to be pulled, a camming assembly selectively movably mounted on said cylindrical housing, said camming assembly including a mooring ring selectively threadably mounted on said externally threaded portion of said cylindrical housing, said camming assembly including a non-rotatable cam ring means operatively secured to said mooring ring whereby threadable rotation of said mooring ring causes axial movement of said cam ring means with respect to said cylindrical housing, said cam ring means being operatively secured to said claw members whereby axial movement of said cam ring means causes said claw members to pivotally move, and an elongated hydraulic cylinder means extending into said open butt end of said housing and being selectively removably mounted therein whereby said hydraulic cylinder means may be removed from said housing for repair or replacement without the disassembly of other components of the puller, said hydraulic cylinder means having a ram movably extending through the head end of said cylindrical housing for engagement with the end of the shaft upon which the gear is mounted.

2. The puller device of claim 1 wherein said ram has a bore formed in its outer end, a ram tip selectively removably mounted in said ram bore, and a detent means yieldably maintaining said ram tip in said ram bore.

3. The puller device of claim 1 wherein said hydraulic cylinder means is threadably mounted in said cylindrical housing.

* * * * *